United States Patent [19]

Rowell et al.

[11] 4,104,903

[45] Aug. 8, 1978

[54] APPARATUS FOR EXTRUSION OF TUBES

[75] Inventors: Douglas W. Rowell, Woodbury, Conn.; Werner Rethmann, Georgsmarienhuette, Fed. Rep. of Germany

[73] Assignee: Kabel-und Metallwerke Gutehoffnungshuette AG, Fed. Rep. of Germany

[21] Appl. No.: 782,773

[22] Filed: Mar. 30, 1977

[30] Foreign Application Priority Data

| | | | |
|---|---|---|---|
| Mar. 31, 1976 | [DE] | Fed. Rep. of Germany | 2613684 |
| Mar. 31, 1976 | [DE] | Fed. Rep. of Germany | 2613685 |
| Mar. 31, 1976 | [DE] | Fed. Rep. of Germany | 2613686 |
| Apr. 30, 1976 | [DE] | Fed. Rep. of Germany | 2619047 |

[51] Int. Cl.[2] ..... B21C 23/08; B21C 25/08; B21C 26/00

[52] U.S. Cl. ..... 72/264; 72/273

[58] Field of Search ..... 72/253, 264, 273, 265, 72/266, 267

[56] References Cited

U.S. PATENT DOCUMENTS

| | | | |
|---|---|---|---|
| 571,332 | 11/1896 | Bicheroux | 72/264 |
| 603,787 | 5/1898 | Holinger | 72/273 X |
| 1,743,687 | 1/1930 | Robertson | 72/273 |
| 2,904,830 | 9/1959 | Mulrooney, Jr. | 72/273 |
| 3,263,468 | 8/1966 | Rowell | 72/273 X |

FOREIGN PATENT DOCUMENTS

| | | | |
|---|---|---|---|
| 839,814 | 6/1960 | United Kingdom | 72/264 |

*Primary Examiner*—C.W. Lanham
*Assistant Examiner*—D. M. Gurley
*Attorney, Agent, or Firm*—Marn & Jangarathis

[57] ABSTRACT

An improved construction of an extrusion press for producing an extruded tube is disclosed, the press including a billet chamber and a ram adapted to drive a billet through the billet chamber, a sizing means comprising an annular die, and a mandrel for sizing the wall thickness of the tube. The improved construction including a mandrel support means attached to and concentrically extending from the front face of the mandrel for maintaining continuous coaxial alignment of the mandrel with the die, prior to and during the extrusion operation.

4 Claims, 2 Drawing Figures

APPARATUS FOR EXTRUSION OF TUBES

Figure 1:
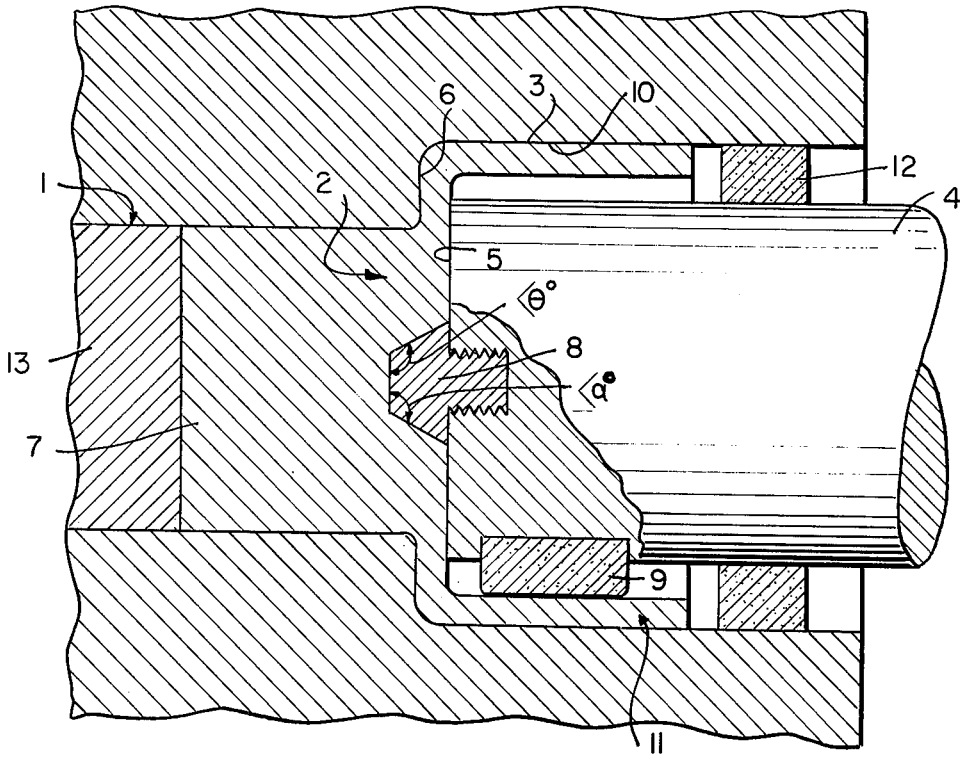

This invention relates to an apparatus for extruding tubes having a larger diameter than the billet from which it is extruded and, more particularly, to an extrusion press having an improved die and mandrel arrangement which permits a tube to be extruded having improved uniformity of the wall thickness and an inside diameter larger than the diameter of the mandrel.

U.S. Pat. No. 3,263,468 discloses apparatus for extruding tubes from billets wherein the resultant tube has a larger inside diameter than the diameter of the mandrel about which it is extruded. Apparatus is described in such patent for controlling the flow of the metal so that it extrudes outwardly and away from a mandrel against a die surface, the resulting extruded tube having an inside diameter larger than the diameter of the mandrel. Owing to the fact that the inside diameter of the extruded tube is larger than that of the mandrel, there is no binding of the tube on the mandrel and the tube can therefore be quickly and easily removed.

In accordance with one of the embodiments of such patent, the extrusion apparatus for producing such an extruded tube is a press that has a billet chamber and a ram for forcing a billet through such chamber. There is provided in such embodiment an outwardly flared die at the outlet end of the billet chamber, and a mandrel about which the billet is extruded into tube form. The mandrel has a flared mandrel surface extending outwardly at an angle to the axis of the press and terminating in a maximum sizing diameter. Also, the die has a flared die surface extending outwardly from the outlet end of the billet chamber to a diameter greater than the maximum sizing diameter of the mandrel. The mandrel surface and the die surface are in axial spaced relationship and define therebetween outwardly extending aperture sizing means for determining the wall thickness of the tube and directing metal flow outwardly away from said mandrel and then axially into an extruded tube having an inside diameter greater than the maximum sizing diameter of the mandrel.

The method employed by such patented embodiment for extruding tubes consists of upsetting a billet about a mandrel and forcing the upset billet outwardly to a first position in an annular aperture between the mandrel and the die. The billet is then extruded outwardly beyond the first position to form a tubular wall of greater diameter than the diameter of the billet before upsetting about the mandrel and to size the thickness of the wall of the tube. The tubular wall is forced outwardly to a second position away from the mandrel to a greater diameter than the diameter of the tubular wall at the first position. The outward flow is then changed to an axial direction at the second position to form a tube shape which is free from the mandrel except at said first position.

The aforesaid apparatus of the prior art has the disadvantage of presenting difficulty in guiding the mandrel with regard to the die surface, thus the extruded tubes cannot be made with the desired degree of uniformity of wall thickness. Further, an excessive amount of the extruding force is required at the flat surface of the prior art mandrels to overcome frictional forces. In the use of extrusion apparatus known prior to that disclosed in U.S. Pat. No. 3,263,468, fluctuations of wall thickness of up to 15% were considered not unusual, while wall thickness differentials in the circumferential direction of less than 1% have been realized with the use of the aforesaid apparatus of the 3,263,468 patent.

It is an object of this invention to improve the aforementioned prior apparatus in such a manner than the resulting extruded tubes have a wall thickness differential in the circumferential direction of less than that obtained from any priorly known apparatus. Such object is achieved in accordance with the instant invention by novel modification of the extrusion apparatus of the aforesaid U.S. Pat. No. 3,263,468, which result in maintaining the free end of the mandrel in a positive and continuous concentric relationship with the inner surface of the die surface.

In a first exemplary embodiment of the instant invention, an annular insert is attached to and concentrically protrudes from the center of the free front face of the mandrel. This annular insert consists of a high heat resistance material that protrudes into the front face of the billet which is pushed by an extruding ram against the mandrel and centers the mandrel in a predetermined axial position with respect to the die surface during the total extruding operation. Further, an arcuate insert is mounted partially within the mandrel in the area of the lower longitudinal surface thereof and protrudes therefrom. The dimension of such insert in the circumferential direction corresponds to a substantial fraction of the circumference of the mandrel and extends in the axial direction with the die surface. This arcuate insert is supported by the inner wall of the extruding tube and in turn supports the elongated mandrel so as to retain a desired predetermined axial alignment during the extrusion operation. Additionally, in accordance with the instant invention, before the extrusion operation there may be provided a displaceable ring in the annular space between the mandrel and the inner surface of the die surface, the ring being axially displaceable in the direction of extrusion. This displaceable ring provides the desired alignment of the mandrel with respect to the die surface and supports the weight of the mandrel so as to prevent misalignment or displacement prior to and at the initial commencement of the extrusion operation.

In a second exemplary embodiment of the instant invention, a centering rod is attached to and concentrically protrudes from the center of the mandrel front face, the length of the centering rod being at least the length of the billet within the billet chamber. In this embodiment the ram has a hollow tubular configuration the open end of which is positioned against a centrally apertured extruder disk slideably positioned within the billet chamber. The billet chamber, the aperture of the extruder disk and the centering rod of the mandrel are all so configurated as to assure positive axial alignment with each other; such rod and aperture having approximately equal diameters permitting the rod to extend tightly through said aperture for maintaining, prior to and during the extrusion operation, such axial alignments in a positive continuous manner. Since the centering rod as well as the front face of the mandrel are subject to wear, it is advantageous to mount the centering rod on a mandrel disk which is removably mounted on and concentrically positioned with respect to the front face of the mandrel body. Further, it is advantageous to provide a concentric recess in the front face of the mandrel disk which faces the billet. By having the outer diameter of such concentric recess correspond almost to the cross section of the billet, the recess receives the cinder layer of the billet which results in a very clean inner surface of the extruding tube.

Preferred embodiments of the invention are described hereinbelow with reference to the drawings wherein:

FIG. 1 is a partial section of a first embodiment of a die and mandrel configuration of an extrusion apparatus of the type described in U.S. Pat. No. 3,263,468, except that the extrusion alignment is in the horizontal rather than the verticle plane.

Figure 2:
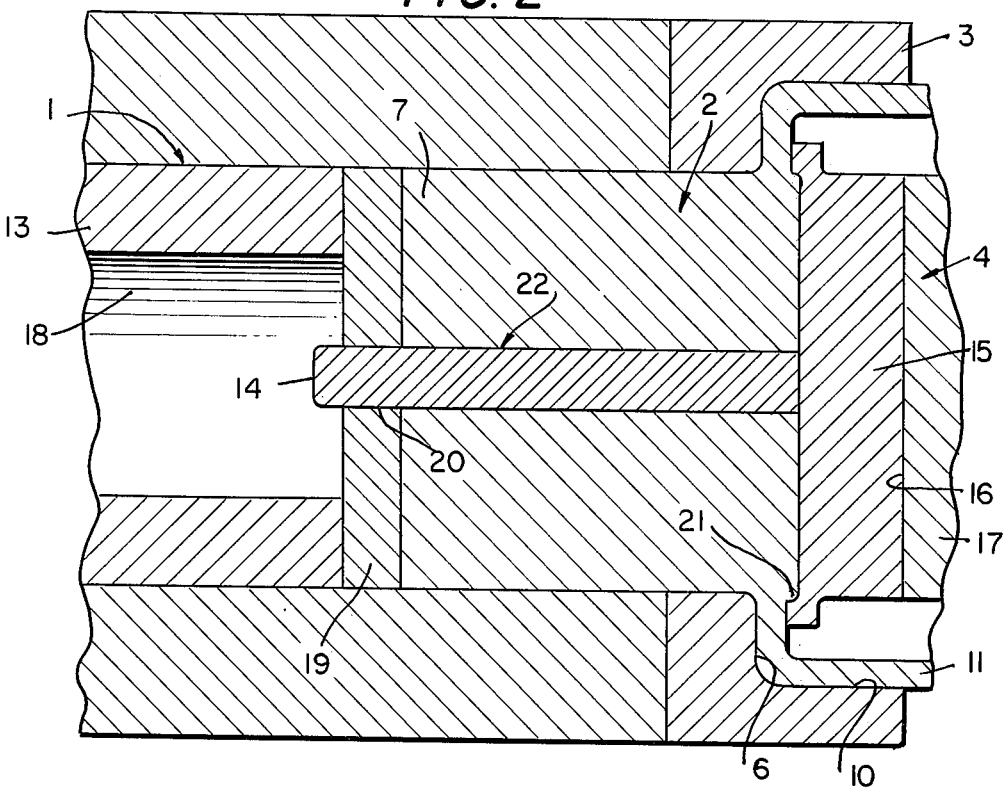

FIG. 2 is a section of a second embodiment of a die and mandrel configuration of an extrusion apparatus of the type described in U.S. Pat. No. 3,263,468, again having the extrusion alignment in the horizontal rather than the verticle plane.

Referring to FIG. 1, there is depicted an apparatus for extrusion comprising a conventional hydraulically operated ram 13 which extends axially into a container 1. The container 1 defines a billet chamber 2 and an extrusion die 3. The extrusion die 3 has a die surface 6 which flares outwardly from the outlet end of the billet chamber 2, and then turns 90° to form a cylindrical die wall 10. Extending through and in axial alignment with the cylindrical die wall 10 is an elongated cylindrical mandrel 4 which is affixed to a suitable hydraulic press or the like (not shown) for moving it axially toward and away from the billet chamber 2. The elongated cylindrical mandrel 4 has a mandrel face 5 which in its operational position is axially spaced from the die surface 6 so as to define an annular outwardly extending aperture which leads from the outlet of the billet chamber 2 to the maximum sizing diameter of the mandrel 4. An annular insert 8 of high resistant material is attached to and concentrically extends from the mandrel surface 5. Preferably, the annular insert 8 is cone shaped in such a manner that the angle $<\alpha$ between front face and lower cone face is smaller than the angle $<\theta$ between the front face and the upper cone face, whereby during the extrusion operation forces are applied by the metallic billet 7 to the annular insert 8 which supports the end of the elongated cylindrical mandrel 4 at the mandrel face 5, and thus aids in the maintenance of exact coaxial alignment of the cylindrical mandrel 4 with the cylindrical die wall 10. Additionally, an arcuate insert 9 is mounted partially within the elongated cylindrical mandrel 4 in the area of the lower longitudinal surface thereof. The arcuate insert 9 is preferably dimensioned in the circumferential direction so as to correspond to that of at least one half of the circumference of the elongated mandrel 4, and is positioned into a recess in the cylindrical surface of the mandrel 4 spaced apart from the mandrel face 5. This positioning assures that the arcuate insert 9 can not be drawn off by the extruding tube 11. In order to prevent damage to the inner surface of the extruding tube 11 by the arcuate insert 9, it is advantageous that the insert 9 consists of self lubricating material, for example, graphite. The radial protrusion of the arcuate insert 9 from the cylindrical surface of the mandrel 4 is such as to correspond to approximately one half the difference of the inner diameter of the extruding tube 11 and the outer diameter of the elongated cylindrical mandrel 4. Further, before the extrusion operation commences, there may be provided a displaceable ring 12 in the annular space between the elongated cylindrical mandrel 4 and the cylindrical die wall 10, to support the cylindrical mandrel 4 in a predetermined axial alignment with the outlet of the billet chamber 2. This displaceable ring 12 should also be made of a self lubricating material, preferably graphite, so that the ring can be easily displaced by the extruding tube 11 which discharges through the aforesaid annular space.

A brief description of the extrusion operation of the embodiment of FIG. 1 is as follows:

The container 1 and the cylindrical mandrel 4 are preheated as is a solid cylindrical shaped metallic billet 7 loaded into the front end of the billet chamber 2. The elongated cylindrical mandrel 4 is slideably positioned in the vicinity of the outlet of the billet chamber 2 opposite the die surface 6, and the ram 13 is operated to move the metallic billet 7 toward and into engagement with the mandrel face 5. Such movement causes the annular insert 8 to penetrate into the front face of the metallic billet 7, thus providing a centric mounting of the elongated cylindrical mandrel 4 at the mandrel face 5. When the ram 13 is further driven, metal of the billet 7 flows radially through the annular aperture formed between the mandrel face 5 and the die surface 6. The distance between the mandrel face 5 and the die surface 6 defines the wall thickness of extruding tube 11. At the transition from the die surface 6 to the die wall 10 the extruded metal is diverted (directed by about 90°) and flows in the direction of the motion of the ram 13, and thereby expels the displaceable ring 12 from the annular space between the die wall 10 and the elongated cylindrical mandrel 4. When the displaceable ring 12 is so expelled, the arcuate insert 9 is supported by the inner wall of the extruding tube 11, which in turn supports the elongated cylindrical mandrel 4. This support of the mandrel 4 is supplemental to the support derived from the above mentioned conical shaped configuration of the annular insert 8 by means of the different inclination angles $<\alpha$ and $<\theta$. The extrusion operation is complete when the front face of the ram 13 comes into close proximity to the front face of the annular insert 8. At such time the elongated cylindrical mandrel 4 is withdrawn and in a subsequent operating step the extruded tube 11 is removed from its position about the mandrel 4. This operational step may be combined with a simultaneous smoothing operation, whereby extruded tube 11 is drawn through a second forming die (not shown).

Referring to FIG. 2, there is depicted an alternative apparatus for extrusion comprising a conventional hydraulically operated ram 13 which extends into a container 1. The container 1 defines a billet chamber 2 and an extrusion die 3. The extrusion die 3 has a die surface 6 which flares outwardly from the outlet end of the billet chamber 2, and then turns 90° to form a cylindrical die wall 10. Extending through and in axial alignment with the cylindrical die wall 10 is an elongated cylindrical mandrel 4 which is affixed to a suitable hydraulic press or the like (not shown) for moving it axially toward and away from the billet chamber 2. The elongated cylindrical mandrel 4 comprises a centering rod 14 that is attached to and concentrically protrudes from a cylindrical mandrel disk 15, which in turn is removably mounted on and concentrically positioned with respect to the front face 16 of the mandrel body 17. In the embodiment of FIG. 2, the ram 13 has an elongated tubular aperture 18 the open end of which is positioned against a central aperture cylindrical extruder disk 19 positioned within the billet chamber 2 for slideable axial movement therein. The diameter of the central aperture 20 of the disk 19 is such as to permit the centering rod 14 to tightly pass therethrough, as the disk 19 is moved axially by the ram 13 during the extrusion operation. Accordingly, the billet chamber 2 supports the disk 19 which in turn supports the centering rod 14, thus providing centric alignment of the elongated cylindrical mandrel 4 during the extrusion operation. Further, a concentric recess 21 is provided in the front face of the mandrel disk 15. Preferably, the outer diameter of the recess 21 corresponds almost to the diameter of a billet 7 positioned within the billet chamber 2, for receiving any cinder layer of the billet surface to acheive a very clean inner surface of the extruded tube 11.

A brief description of the extrusion operation of the embodiment of FIG. 2 is as follows:

A cylindrically shaped metallic billet 7 having an elongated concentric bore 22 is loaded in the billet chamber 2, and the elongated cylindrical mandrel 4 is moved toward the billet chamber 2 so that the centering rod 14 extends axially through the metallic billet 7 as well as through the central aperture 20 of the extruder disk 19. The elongated cylindrical mandrel 4 is slideably positioned so that the front face of the cylindrical mandrel disk 15 is in vicinity of the outlet of the billet chamber 2 opposite the die surface 6. The ram 13 is operated to move the extruder disk 19 against the metallic billet 7 which is forced toward and into engagement with the front face of the mandrel disk 15 having a concentric recess 21. As the ram 13 is further driven, the metal of the metallic billet 7 flows substantially radially through the annular aperture formed between the cylindrical mandrel disk 15 and the die surface 6. The distance between the unrecessed surface of the mandrel disk 15 and the directly opposite surface of the die surface 6 defines the wall thickness of the extruding tube 11. As in the first embodiment, at the transition from the die surface 6 and the die wall 10, the extruded metal is diverted (redirected by about 90°) and flows in the direction of the motion of the ram 13 to form a tubular configuration having an inner diameter greater than the largest portion of the elongated cylindrical mandrel 4, namely, greater than the diameter of the cylindrical mandrel disk 15. At the start of the extrusion operation as well as during the total time period of the extrusion, the axial position of the elongated cylindrical mandrel 4 is maintained in exact alignment with the outlet of the billet chamber 2 and the cylindrical die wall 10 by means of the cooperation of the centering rod 14 and the cylindrical extruder disk 19. Consequently, differences in wall thickness in the circumferential direction of extruding tube 11 due to axial displacement of the elongated cylindrical mandrel 4, for example, due to its weight as occurred in the priorly known devices is prevented.

We claim:

1. In an extrusion press for producing an extruded tube wherein said press has a billet chamber and a ram adapted to drive a billet through said billet chamber, sizing means comprising an annular die at the outlet end of the billet chamber, said die having a substantially cylindrical portion of larger diameter than the billet at the outlet end of the chamber for sizing the outside diameter of an extruded tube, and an elongated cylindrical mandrel for sizing the wall thickness of the tube, said mandrel spaced concentrically within the die and having a maximum sizing diameter situated in juxtaposition with the cylindrical portion of said die and defining with said die a horizontally extending annular aperture through which said billet is extruded, said juxtaposition of said die and said mandrel being such that said billet is extruded outwardly away from said mandrel until it abuts said cylindrical portion of said die and then forms an extruded tube having an inside diameter greater than the maximum sizing diameter of said mandrel; the improved contruction characterized by said mandrel comprising a cone shaped annular insert extending into said die from the front face of the mandrel, said mandrel further being provided with an arcuate insert mounted partially within said mandrel in the area of the lower longitudinal surface thereof, such arcuate insert being dimensioned in the circumferential direction so as to correspond to that of at least one half of the circumference of said mandrel and having a radial protrusion from the mandrel face that is supported by the inner wall of the extruded tube during the extrusion operation.

2. The improved extrusion press in accordance with claim 1, wherein said annular insert is shaped in such a manner that a first angle between a front face of the annular insert and its lower cone face is smaller than the angle between the front face and its upper cone face, whereby during the extrusion operation forces are applied by the billet to the annular insert which supports the end of said mandrel.

3. The improved extrusion press in accordance with claim 1, wherein the radial protrusion of said arcuate insert from the mandrel face corresponds to about one half the difference of the inner diameter of the extruded tube and the outer diameter of said mandrel.

4. The improved extrusion press in accordance with claim 1, wherein before the extrusion operation commences there is provided a self lubricating, displaceable ring in the annular space between said mandrel and the larger diameter cylindrical portion of said die for supporting said mandrel in a predetermined alignment, said displaceable ring being discharged by the extruded tube upon the commencement of the extrusion operation.

* * * * *